US005282344A

United States Patent [19]

Moore

[11] Patent Number: 5,282,344

[45] Date of Patent: Feb. 1, 1994

[54] FLEXIBLE J-CHANNEL FOR MASKING SIDING

[75] Inventor: Sylvia E. Moore, Sidney, Ohio

[73] Assignee: Aluminum Company of America, Pittsburgh, Pa.

[21] Appl. No.: 873,812

[22] Filed: Apr. 27, 1992

[51] Int. Cl.[5] ..... E04F 19/02; E04G 23/00

[52] U.S. Cl. ..... 52/716.8; 52/211; 52/717.01; 52/748

[58] Field of Search ..... 52/716.8, 717.01, 85, 52/717.03, 717.05, 718.01, 556, 631, 211, 58, 62, 747, 748

[56] References Cited

U.S. PATENT DOCUMENTS

| | | | |
|---|---|---|---|
| 4,188,765 | 2/1980 | Jackson | 52/716.8 |
| 4,341,048 | 7/1982 | Minter | 52/717.01 |
| 4,920,709 | 5/1990 | Garries et al. | 52/718.01 |
| 5,103,612 | 4/1992 | Wright | 52/288 |

*Primary Examiner*—Michael Safavi

*Attorney, Agent, or Firm*—Glenn E. Klepac

[57] ABSTRACT

A flexible J-channel for masking marginal portions of siding on buildings. The J-channel has a relatively rigid base wall and relatively flexible rear and retainer walls which allow flexing when the J-channel is bent in an arc. The uncut flexible rear wall provides excellent resistance to moisture penetration.

18 Claims, 1 Drawing Sheet

FLEXIBLE J-CHANNEL FOR MASKING SIDING

FIELD OF THE INVENTION

The present invention relates to J-channels which are employed for masking marginal portions of vinyl and aluminum siding near junctures with arched windows, pediments, or other structures having curved frames.

BACKGROUND OF THE INVENTION

Conventional J-channels are formed by extrusion of filled polymer compounds having uniform composition and a single durometer (hardness) rating. These J-channels perform well around structures having substantially straight sides. However, usage of the prior art J-channels around curved openings or curved structures (e.g., round or half round windows or round louvers) is difficult. Fitting of conventional J-channels around such structures requires cutting of the rear legs or both the front and rear legs followed by patching with caulking compound or other similar material to avoid gaps.

Garries et al U.S. Pat. No. 4,920,709 discloses a J-channel member for accommodating junctures between siding and radiused openings. The patented member includes a bottom wall, a front leg, and a back leg. The back leg is made of a relatively rigid plastic material and has vertically extending through slits to permit bending of the bottom wall around a radiused opening.

It is a principal objective of the present invention to provide a flexible J-channel that is readily bent around curved openings and curved building structures.

A related objective of the invention is to provide a J-channel that is coextruded as a one-piece structure with a base wall of relatively rigid polymer composition and front and rear walls of relatively flexible polymer composition.

Another objective of the invention is to provide a J-channel having a rear wall that is uninterrupted by through slits which might detract from strength and weather resistance.

Additional objects and advantages of the present invention will become apparent to persons skilled in the art from the following specification and claims.

SUMMARY OF THE INVENTION

In accordance with the present invention, there is provided a J-channel for masking non-linear marginal portions of siding on building exteriors. Such marginal portions appear adjacent curved or irregularly shaped wall structures such as half round windows. The J-channel comprises a base channel, a retainer wall extending upwardly from the base channel, and a rear wall extending upwardly from the base wall a greater distance than the retainer wall.

The base channel includes a base wall made of a relatively rigid polymer composition. The retainer wall is made of a relatively flexible polymer composition so as to facilitate insertion and retention of siding marginal portions between the retainer wall and rear wall. The rear wall is made of a sufficiently flexible polymer composition to permit stretching without breakage and without cutting any slits when the base channel is bent in an arc.

In a preferred embodiment, the base channel includes front and rear edge portions made of a relatively rigid polymer composition. The retainer wall extends upwardly from the front edge portion, generally normal to the base wall, and generally parallel to the rear wall. The rear wall extends upwardly from the rear edge portion, generally normal to the base wall.

The flexible J-channel is preferably coextruded as an integral one-piece structure from a polymer composition comprising polyvinyl chloride, mineral fillers, and other ingredients. The retainer wall and rear wall have relatively greater flexibility than the base wall because they contain a plasticizer which the base wall does not have.

The flexible J-channel is deployed by first fastening one end of the rear wall to a building exterior, for example by hammering a nail through the rear wall adjacent a first lateral end portion. The J-channel is bent in an arc without slitting the rear wall, following the outline of a window frame or other protruding structural element. The rear wall is then successively fastened to the exterior at several laterally spaced locations, ending adjacent a second lateral end portion of the J-channel. A marginal portion of the siding is then received and retained between the retainer wall and the rear wall.

DETAILED DESCRIPTION OF A PREFERRED EMBODIMENT

Figure 1:
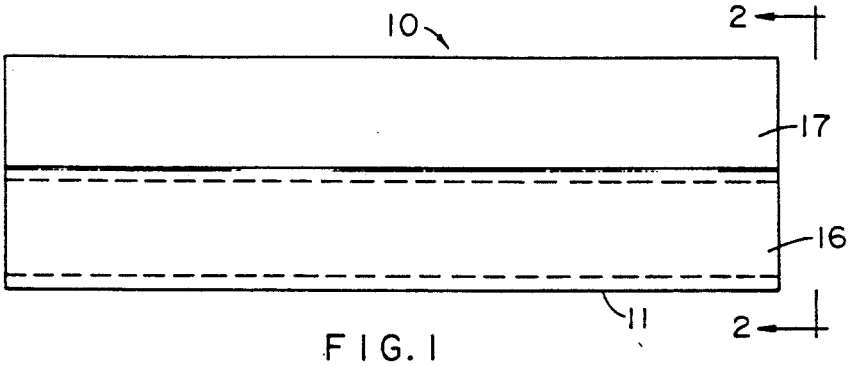
FIG. 1 is a front elevational view of a dual durometer extrusion flexible J-channel made in accordance with the present invention.
Figure 2:
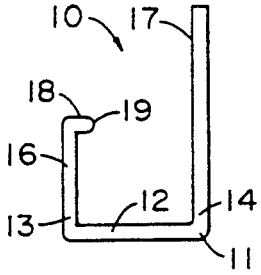
FIG. 2 is a cross-sectional view taken along the lines 2—2 of FIG. 1.

A particularly preferred elongated flexible J-channel 10 of the invention is shown in FIGS. 1 and 2. The J-channel 10 includes a base channel 11 formed by a base wall 12, a front edge portion 13, and a rear edge portion 14. A retainer wall or front wall 16 extends upwardly from the front edge portion 13, and a rear wall 17 extends upwardly from the rear edge portion 14. An upper edge portion 18 of the retainer wall 16 includes a small, rearwardly directed lip or boss 19. The rear wall 17 extends above the base wall 12 approximately twice as high as the retainer wall 16.

The J-channel 10 of FIGS. 1 and 2 has external dimensions of 1½ inches high by 1 inch wide and a wall thickness of approximately ⅛ inch. These sizes may be varied, depending upon the thickness of siding and the particular dimensions of the exterior structure to be outlined.

The J-channel 10 of the invention is preferably coextruded from a mixture of polyvinyl chloride (PVC) and several additives. Among the substances added to the PVC are mineral extenders and pigments (such as titanium dioxide, kaolin, calcium carbonate, mica, talc, and magnesium oxide); heat stabilizers which are preferably organotin compounds; impact modifiers such as acrylic copolymers and acrylonitrile butadiene-styrene resins; plasticizers such as dioctyl phthalate, di(2-ethylhexyl) phthalate and Monsanto 711; and various other processing aids, lubricants, and ultraviolet light stabilizers. The base channel 11, retainer wall 16, and rear wall 17 all generally contain the same ingredients. However, the retainer wall 16 and rear wall 17 contain a higher proportion of plasticizer than the base channel 11 so that they will be relatively more flexible than the base channel 11. In the particularly preferred embodiment described herein, the durometer hardness of the base channel 11 is about 95 Shore A, and the retainer and rear walls each have a durometer hardness of about 80 Shore A.

Figure 3:
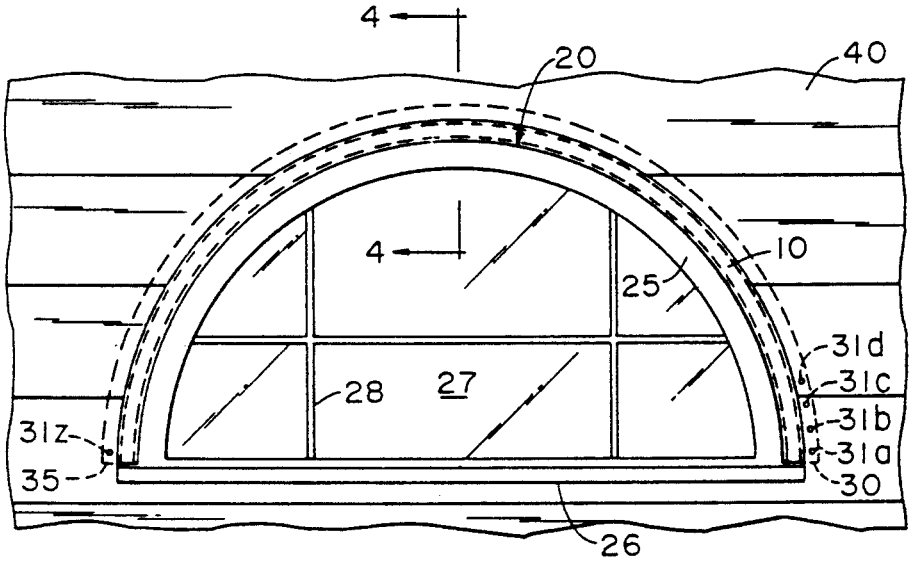
FIG. 3 is a fragmentary front elevational view of a building showing the flexible J-channel of the invention.
Figure 4:
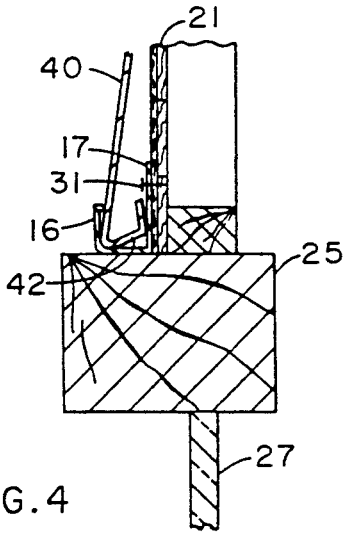
FIG. 4 is a cross-sectional view taken along the lines 4—4 of FIG. 3.

Referring now to FIGS. 3 and 4, there is shown a half-round window 20 in a building exterior or exterior wall 21. The window 20 includes an arcuate upper frame 25, a linear lower frame 26, and panes of glass 27 separated by dividers 28. The frames 25, 26 and dividers 28 may be made from wood or vinyl.

In order to mask marginal portions of siding adjacent the window upper frame 25, a J-channel 10 is fixed to the exterior wall 21. A first end portion 30 of the J-channel 10 is positioned next to an end on the upper frame 25, and then a corrosion resistant nail 31*a* is hammered through the rear wall 17 and exterior wall 21 within about ½ inch of the end portion 30. The J-channel 10 is bent in an arc so that the base wall 12 is closely adjacent to the upper frame 25.

While maintaining constant tension on the J-channel 10, additional nails 31*b*, 31*c*, 31*d* are hammered through the rear wall 17 and exterior wall 21. The last nail 31*z* is fixed about ½ inch from the second end portion 35 of the J-channel 10. Even positioning of the J-channel 10 is assured by nailing the rear wall 17 to the exterior wall 21 strictly in sequence, from first end portion 30 to second end portion 35. This method ensures that the rear wall 17 lies flat against the building exterior 21.

If desired, a silicone sealant may be used to adhere the J-channel rear wall 17 to the exterior 12. The construction shown and described herein has excellent weatherability compared with prior art structures because the uncut rear wall 17 resists moisture penetration. The sealant adds even more water resistance to the completed assembly. A suitable sealant is sold by Alcoa Building Products of Sidney, Ohio under the trade name Alcoa XL200 High Modulus Silicone Sealant.

After the J-channel 10 is affixed to the exterior 21, vinyl, aluminum or wood siding panels 40 are added over the exterior 21. These panels 40 often have ragged unsightly lower marginal portions 42 which are masked by the flexible retainer walls 16. As shown in FIG. 3, the J-channel 10 provides an attractive, neat appearance adjacent the window 20.

Persons skilled in the art will understand that the present invention may be embodied in other specific forms without departing from the essential characteristics described above. The preferred embodiments should be considered as illustrative rather than restrictive, and the invention may be modified without departing from the spirit and scope of the following claims.

What is claimed is:

1. A covered building exterior comprising:

(a) an exterior wall;

(b) a vinyl, aluminum or wood siding panel affixed to said exterior wall and having a curved marginal portion; and (c) an elongated J-channel for masking said curved marginal portion of the siding panel, said J-channel comprising:

(i) a base channel including a base wall and front and rear edge portions extending upwardly from said base wall, said base wall comprising a relatively rigid polymer composition having a durometer hardness of about 95 Shore A;

(ii) a rear wall extending upwardly from the rear edge portion of said base channel, said rear wall being affixed to said exterior wall behind said siding panel by means of a nail or screw, said rear wall being uninterrupted by slits and consisting essentially of a relatively flexible polymer composition having a durometer hardness of about 80 Shore A; and (iii) a retainer wall extending upwardly from said front edge portion and retaining said non-linear marginal portion of the siding panel adjacent said building exterior, said retainer wall comprising a relatively flexible polymer composition having a durometer hardness of about 80 Shore A.

2. The building exterior of claim 1 further comprising:

(d) a silicone sealant adhering said rear wall to said exterior wall.

3. The building exterior of claim 2 further comprising:

(e) a nail or screw inserted through said rear wall and into said exterior wall.

4. An elongated J-channel for masking non-linear marginal portions of siding on building, said J-channel being coextruded from a relatively flexible polymer composition and a relatively rigid polymer composition having a higher durometer hardness than said relatively flexible polymer composition, and comprising:

(a) a base channel including a base wall and front and rear edge portions each extending upwardly from said base wall, said base wall comprising said relatively rigid polymer composition;

(b) a retainer wall for retaining marginal portions of siding adjacent a building exterior, said retainer wall extending upwardly from said front edge portion, said retainer wall comprising said relatively flexible polymer composition; and (c) a rear wall for attachment to a building exterior, said rear wall extending upwardly from said rear edge portion and extending above said base wall a greater distance than said retainer wall, said rear wall being integrally formed without interruption by slits and consisting of said relatively flexible polymer composition.

5. The J-channel of claim 4 wherein said front and rear edge portions comprise said relatively rigid polymer composition.

6. The J-channel of claim 4 wherein said retainer wall comprises an upper edge portion having a lip extending toward said rear wall.

7. The J-channel of claim 4 comprising a one-piece dual durometer polyvinyl chloride composition.

8. The J-channel of claim 4 wherein said retainer wall and said rear wall are generally parallel.

9. The J-channel of claim 4 wherein said rear wall and said retainer wall are generally normal to said base wall.

10. A method for masking arcuate marginal portions of siding on a building exterior comprising the steps of:

(a) providing a flexible elongated J-channel comprising a coextruded polyvinyl chloride composition and having spaced first and second lateral end portions, and further comprising:

(i) a base channel of a relatively rigid polymer composition;

(ii) a retainer wall extending upwardly from a front edge portion of said base channel, said retainer wall having a relatively flexible polymer composition; and (iii) a rear wall integrally formed with said base channel and uninterrupted by slits, said rear wall extending upwardly from a rear edge portion of said base channel a greater distance than said retainer wall, said rear wall consisting essentially of relatively flexible polymer composition, said base channel having a higher durometer hardness than said retainer wall and said rear wall; and (b) fastening said rear wall to a building exterior adjacent a first lateral end portion;

(c) bending said J-channel in an arc without slitting said rear wall;

(d) fastening said rear wall to said building exterior at a plurality of locations paced laterally along said rear wall between the first and second lateral end portions; and (e) receiving and retaining a generally arcuately extending marginal portion of vinyl, aluminum or wood siding between said retainer wall and said rear wall.

11. The method of claim 10 wherein step (b) comprises inserting a nail or screw through said rear wall and into said building exterior.

12. The method of claim 10 wherein after step (c) said second lateral end portion is spaced laterally from said first lateral end portion.

13. The method of claim 10 further comprising:

(f) adhering said rear wall to said building exterior with silicone sealant.

14. The method of claim 10 wherein the rear wall has a height above the base wall approximately twice that of the retainer wall.

15. The method of claim 10 wherein the base channel has a durometer hardness of about 95 Shore A.

16. The method of claim 10 wherein the retainer wall has a durometer hardness of about 80 Shore A.

17. The method of claim 10 wherein the rear wall has a durometer hardness of about 80 Shore A.

18. The method of claim 10 wherein the base channel has a durometer hardness of about 95 Shore A and the rear and retainer wall each have a durometer hardness of about 80 Shore A.

* * * * *